United States Patent [19]

Ricchini

[11] Patent Number: 4,858,398

[45] Date of Patent: Aug. 22, 1989

[54] PREFABRICATED BUILDING CONSTRUCTION

[75] Inventor: John A. Ricchini, Lincoln, Nebr.

[73] Assignee: Universal Simplex Building System, Lincoln, Nebr.

[21] Appl. No.: 324,239

[22] Filed: Nov. 23, 1981

[51] Int. Cl.[4] ..... E04D 3/36

[52] U.S. Cl. ..... 52/90; 52/94; 52/288; 52/293; 52/466; 52/468; 52/584

[58] Field of Search ..... 52/90, 79.9, 94, 79.1, 52/236.1, 79.13, 127.7, 127.11, 278, 285, 580, 584, 288, 466, 468; 24/287; 403/292, 348, 6, 408; 46/31, 25, 19, 16; 446/110, 109, 476, 94, 90

[56] References Cited

U.S. PATENT DOCUMENTS

| | | | |
|---|---|---|---|
| 1,375,402 | 4/1921 | McAvoy | 52/94 |
| 1,825,195 | 9/1931 | McAvoy et al. | 52/127.11 X |
| 2,076,728 | 4/1937 | Keller | 52/90 X |
| 2,093,341 | 9/1937 | Reiche | 46/26 |
| 2,099,075 | 11/1937 | Paulson | 446/110 |
| 2,754,620 | 7/1956 | Gilbert | 46/19 |
| 2,775,799 | 1/1957 | Friderich | 52/584 |
| 2,849,832 | 9/1956 | Jorgensen | 46/26 |
| 3,236,014 | 2/1966 | Edgar | 52/94 X |
| 3,281,998 | 11/1966 | Honold et al. | 52/90 X |
| 3,368,316 | 2/1968 | Crowder | 46/19 |
| 3,886,699 | 6/1975 | Bergmann, Jr. | 52/90 |
| 4,335,558 | 6/1982 | Caldwell et al. | 52/236.1 |

FOREIGN PATENT DOCUMENTS

| | | | |
|---|---|---|---|
| 634909 | 3/1928 | France | 46/19 |

*Primary Examiner*—John E. Murtagh

*Attorney, Agent, or Firm*—Neil F. Markva

[57] ABSTRACT

A prefabricated, modular building construction system uses three basic, proportioned panels, comprising rectangular wall and roof panels and triangular gable panels. The panels are secured together with simple fasteners inserted through aligned openings in adjacent edges of the panels and turned to lock them in place. The gable panels are shaped as right triangles, with the angular disposition of the hypotenuse determining the pitch of the roof and the length thereof having a specific relationship with respect to the length of the roof panels. The lengths of the other two sides also have a particular relationship to the length and width of the wall panels. Thus, the panels may be arranged in any predetermined number and size to define buildings of various sizes and shapes. Each of the panels comprises channel shaped frame members surrounding a rigid insulating core with protective and/or decorative surface layers or sheets laminated on both sides. In constructing a building using the invention, a plurality of panels are assembled on the ground to form a module or bay of the building and the bay is then raised into place. Subsequent bays are similarly constructed on the ground and raised into place to be secured to the preceding bay.

9 Claims, 6 Drawing Sheets

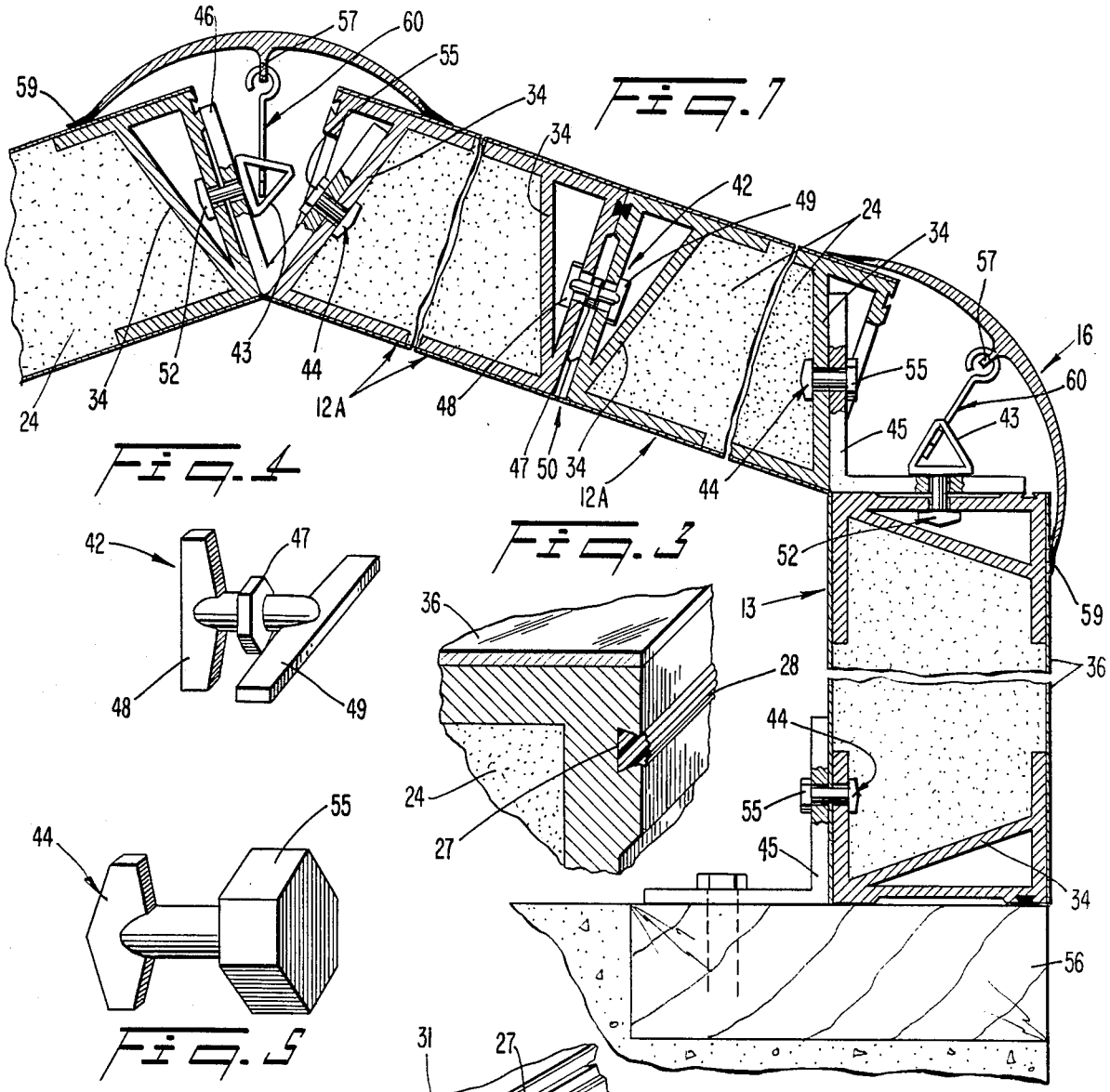
Fig. 7
Fig. 4
Fig. 3
Fig. 5
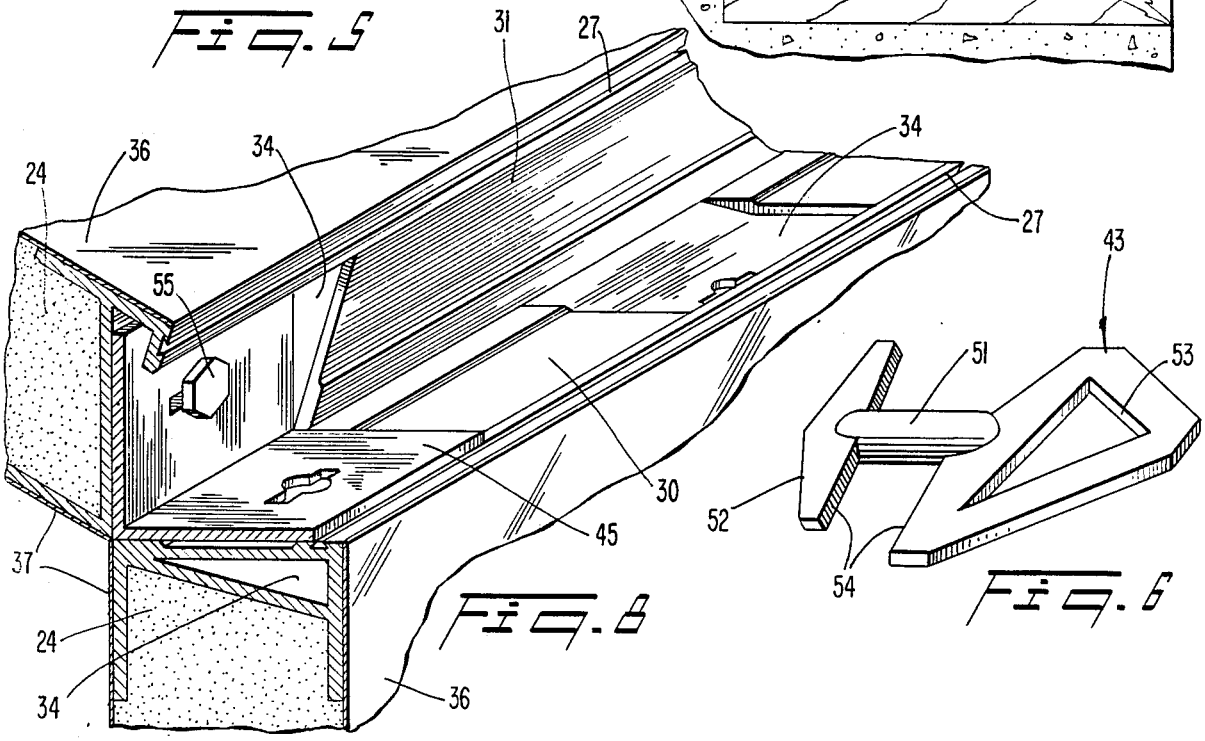
Fig. 8
Fig. 6

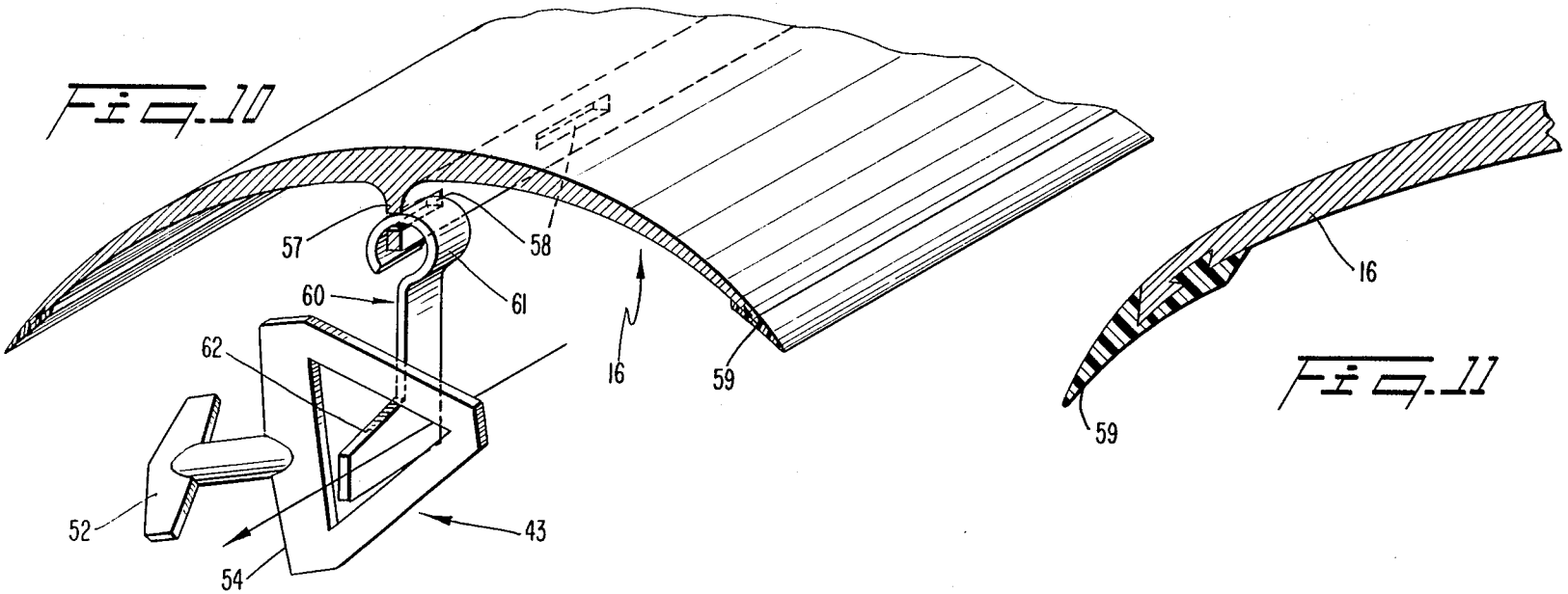
FIG. 10
FIG. 11
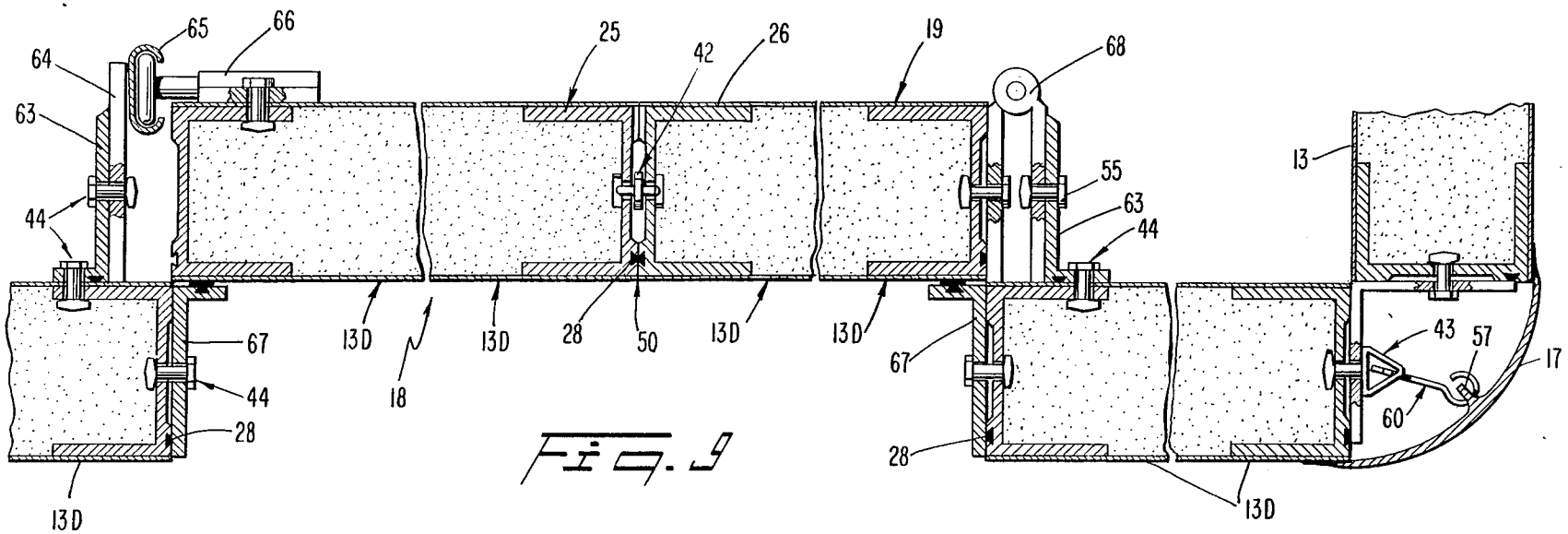
FIG. 9

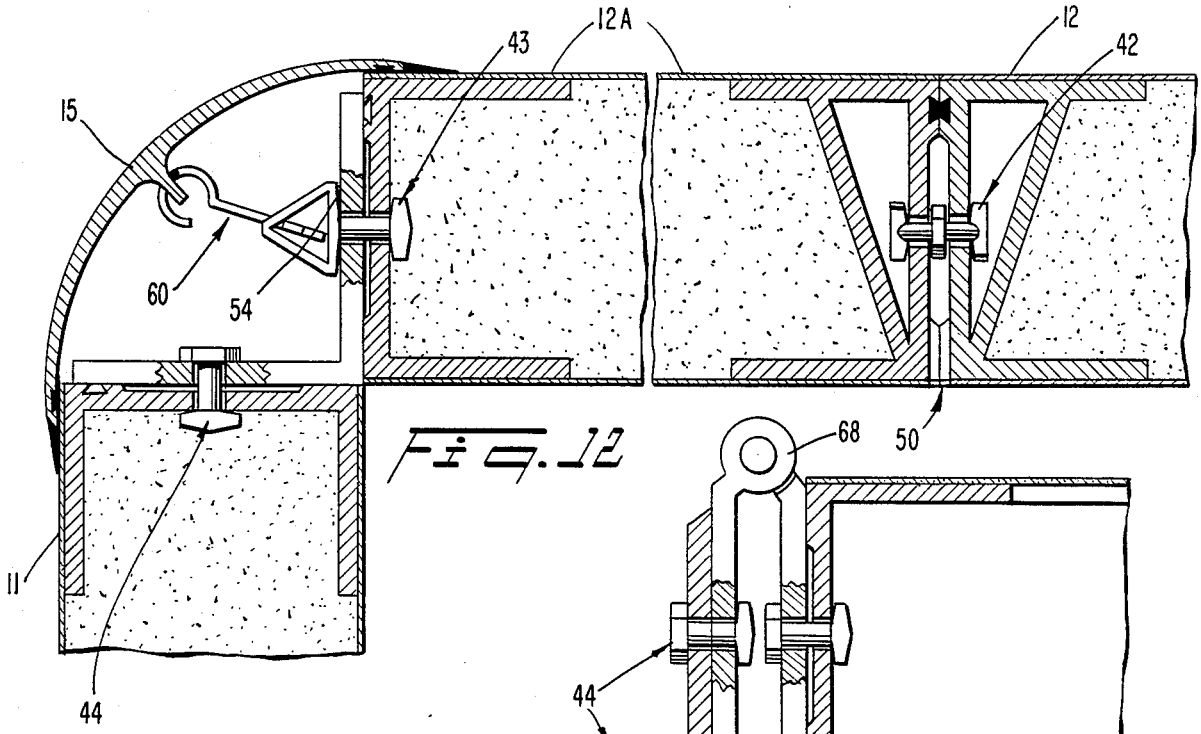
Fig. 12
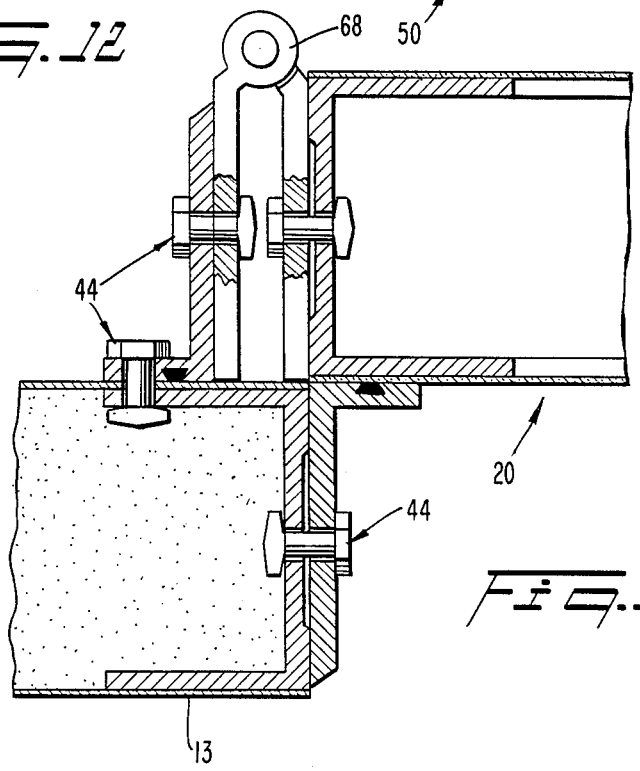
Fig. 13
Fig. 14
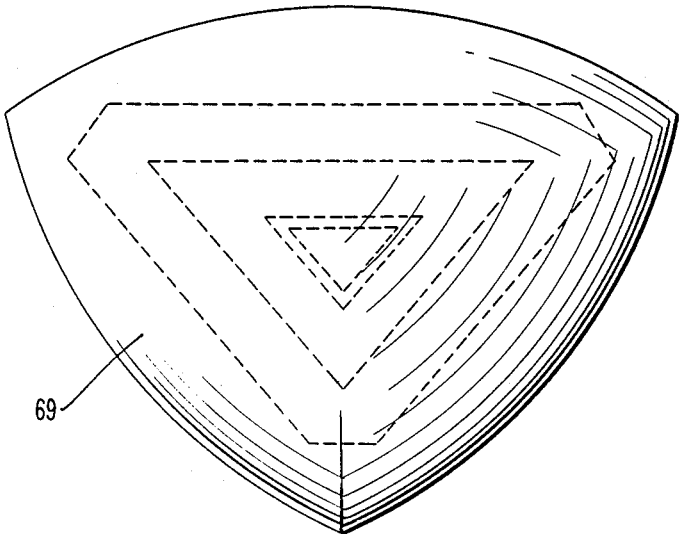
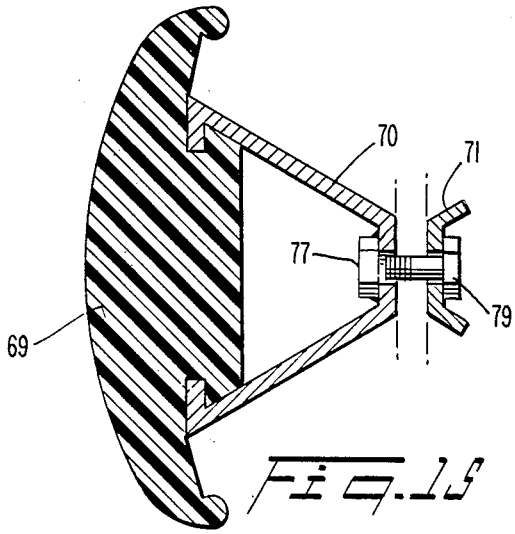
Fig. 15

PREFABRICATED BUILDING CONSTRUCTION

BACKGROUND OF THE INVENTION

This invention relates to a prefabricated building construction More particularly, the invention relates to a building construction in which a plurality of standardized, prefabricated panels are assembled together on the ground to define sections or bays of the building and the bays are then raised into position and secured to one another In the building industry, one of the most significant factors affecting cost of a building program is the amount of time it takes to complete construction Another significant factor is the need to employ heavy, sophisticated equipment for the hoisting and placing of building materials. Even in those instances where prefabricated sections and standarized parts are used in the construction of buildings, a large number of different components and fasteners must be inventoried. Although construction with such systems is faster than with more conventional building methods, considerable time and custom work is still required.

PURPOSE OF THE INVENTION

The primary object of this invention is to provide a building system wherein a minimum number of standarized, prefabricated components, including building panels and fasteners, are assembled together to form major subsections or bays of a building and the bays are then raised into position and secured to one another.

Another object of this invention is to provide a building system wherein rectangular wall and roof panels are related to triangular gable panels such that only one type of gable panel is required anywhere in the gable of the building and only one type of roof panel and wall panel are required anywhere in the roof or wall, respectively, of the building with any of the roof panels being equally usable with any of the gable panels.

A further object of the invention is to provide a building system in which a minimum number of standardized, prefabricated panels have fastener-receiving openings in edge portions thereof, and the panels are secured together by fasteners extended through the openings.

A still further object of this invention is to provide a building construction comprising prefabricated panels having peripheral frame members surrounding a rigid insulating core with protective and/or decorative skins or sheets laminated thereon to define a unitary structure.

Yet another object of the invention is to provide a system wherein essentially the same panel frame may be used to define doors and windows, thereby further reducing the number of parts which must be inventoried than are necessary in known systems.

SUMMARY OF THE INVENTION

These objects and other advantages are accomplished through the building system described herein, in which prefabricated panels, fasteners and finishing devices are utilized. The panels, fasteners and finishing devices are proportioned and designed in such a way that a minimum number of the types and sizes of members is needed in assembling and erecting the building. The panels comprise lightweight, rectangular wall and roof panels and lightweight, triangular gable panels which are assembled in the desired pattern and size on the ground. The assembly is then raised into position to form a section of the building, with the subsequent sections being similarly assembled and erected and then secured to preceding sections.

Single shaped triangular gable panels are right triangles having sides that are mathematically proportioned with respect to each other. The rectangular roof and wall panels have sides that are mathematically proportioned with respect to the sides of the triangular building panels. The relative mathematical proportions are effective to provide a universal combination of the rectangular and triangular building panels for forming any selected combination of a plurality of building sizes and shapes.

The length of the roof panels is equal to a multiple of a whole integer times the length of the hypotenuse whereby any roof panel or panels may be used with any gable panel or panels. The triangular building panel has a hypotenuse side disposed at a predetermined angle with respect to the other two sides. The predetermined angle is equal to the pitch angle of the building being constructed. The rectangular panels have a modular length and width effective to provide a building width that is directly related to the total number of triangular panels used to form a gable end of the building. The width of the roof and wall panels is equal to a multiple of a whole integer times the length of the longer perpendicular side of the triangular gable panel.

Another feature of the invention is the edge structure for each of the panels. Each panel includes a rigid frame structure extending around the periphery thereof. A plurality of spaced, slotted openings are located along the length of each side of the panels. The spaced distances between the openings (1) in the two perpendicular sides of the triangular panel, (2) in the ends and sides of the wall panels, and (3) in the ends of the roof panels are equal to one another. The spaced distances between the openings in the hypotenuse side of the triangular panel and the length of the roof panels are equal to one another.

Attachment of the panels to one another is accomplished by inserting simple, easy to use fasteners through preformed openings in the adjacent edge portions of panels and then turned through a predetermined angle to lock the panels together. The particular structure of the fasteners constitute another feature of the invention.

BRIEF DESCRIPTION OF THE DRAWINGS

Other objects of this invention will appear in the following description and appended claims, reference being made to the accompanying drawings forming a part of the specification, wherein like reference characters designate corresponding parts in the several views.

FIG. 3 is a fragmentary sectional view showing the detail of the sealing bead of this invention;

FIGS. 4, 5 and 6 are perspective views showing different fasteners used in assembling the components of the building structure of the invention;

FIG. 7 is an enlarged vertical sectional view of the building in FIG. 1, taken along line VII—VII;

FIG. 8 is a fragmentary perspective view of the connection between the roof and wall panels at the eave of a building made in accordance with the invention;

FIG. 9 is an enlarged, horizontal sectional view of the building of FIG. 1, taken along line IX—IX;

FIG. 10 is a fragmentary perspective view of one of the closure strips used in the building system of the invention;

FIG. 11 is a sectional view of the closure of FIG. 10 at the outer edge thereof;

FIG. 12 is a sectional view along line XII—XII of FIG. 1;

FIG. 13 is a sectional view along line XIII—XIII of FIG. 1;

FIG. 14 is a plan view of a corner cap used with the building system of the invention;

FIG. 15 is a sectional view of the corner cap shown in FIG. 14;

DETAILED DESCRIPTION

Figure 1:
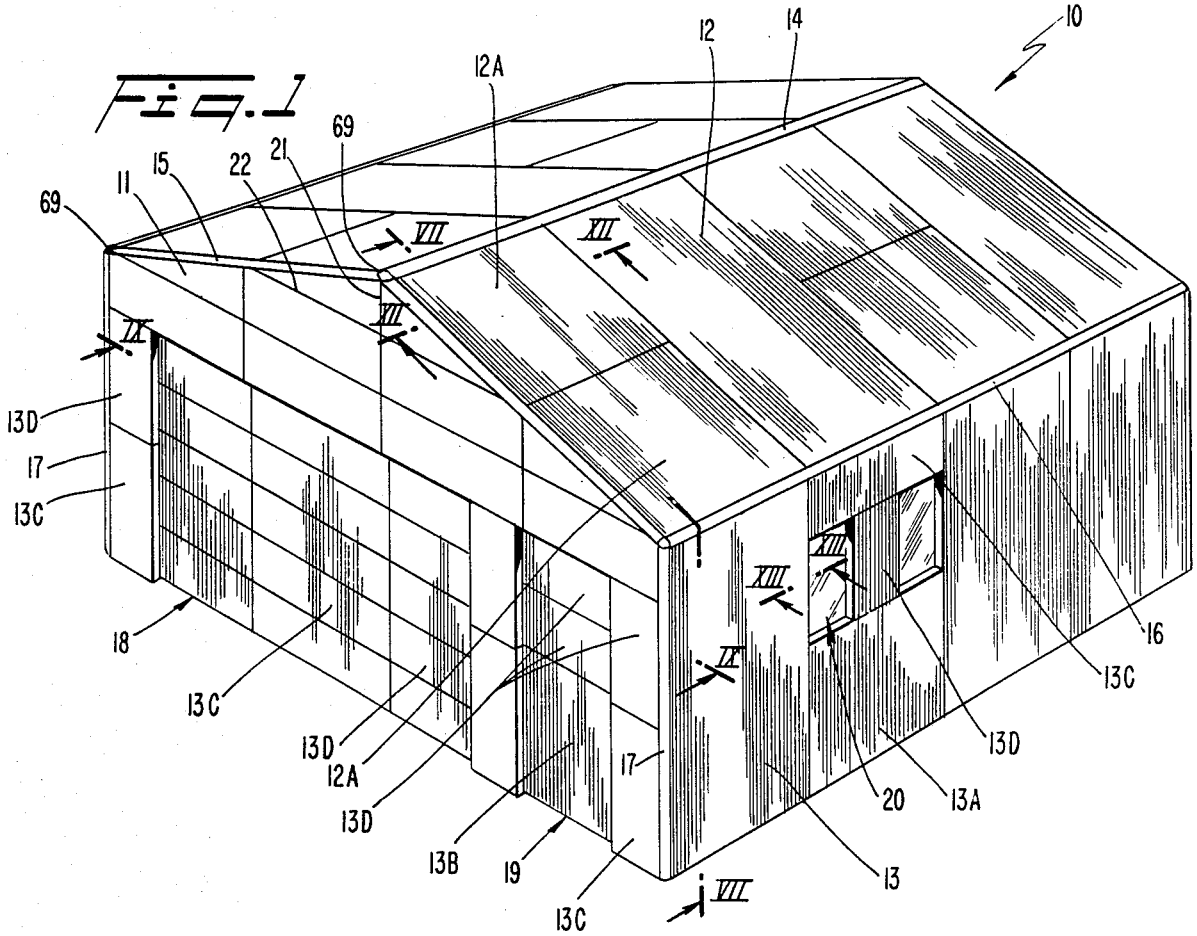
FIG. 1 a perspective view of a building constructed in accordance with this invention.

More specifically, referring to the drawings, a building structure, generally designated 10, comprises a plurality of gable panels 11, roof panels 12 and 12A and wall panels 13, 13A, 13B, 13C and 13D. Closure strips 14, 15, 16 and 17 are disposed at the ridge, gable, eaves and corners, respectively of building 10.

The dimensions of the various roof and wall panels of this specific embodiment are as follows:

| | Length | Width |
|---|---|---|
| Roof Panel 12 | 8 ft. - 5¼in. | 4 ft. - 0 in. |
| Roof Panel 12A | 4 ft. - 2⅝in. | 4 ft. - 0 in. |
| Wall Panel 13 | 8 ft. - 0 in. | 4 ft. - 0 in. |
| Wall Panel 13A | 4 ft. - 0 in. | 4 ft. - 0 in. |
| Wall Panel 13B | 4 ft. - 0 in. | 2 ft. - 8 in. |
| Wall Panel 13C | 4 ft. - 0 in. | 1 ft. - 4 in. |
| Wall Panel 13D | 2 ft. 8 in. | 1 ft. - 4 in. |

Wall panels 13C and 13D are connected together to form an overhead door 18. Wall panels 13B and 13D form hinged entrance door 19. Window panels 20 have the same frame size as wall panels 13D with the insulation left out. Transparent sheets are laminated on opposite sides of the frame as explained below. A special sized wall panel (not shown) having the dimensions of 4'-0"×1'-1" is also available for use as stair treads and other purposes as required. The length of the wall panels is established on a basic measurement unit of one foot four inches.

Gable panels 11 are shaped as right triangles, with a short side 21 and a long side 22 subtending the right angle and a hypotenuse 23 opposite the right angle. Two specific sizes of panels 11 include (1) a short side length of one foot four inches with a long side length of four feet and (2) a short side length of two feet eight inches with a long side length of eight feet.

Figure 2:
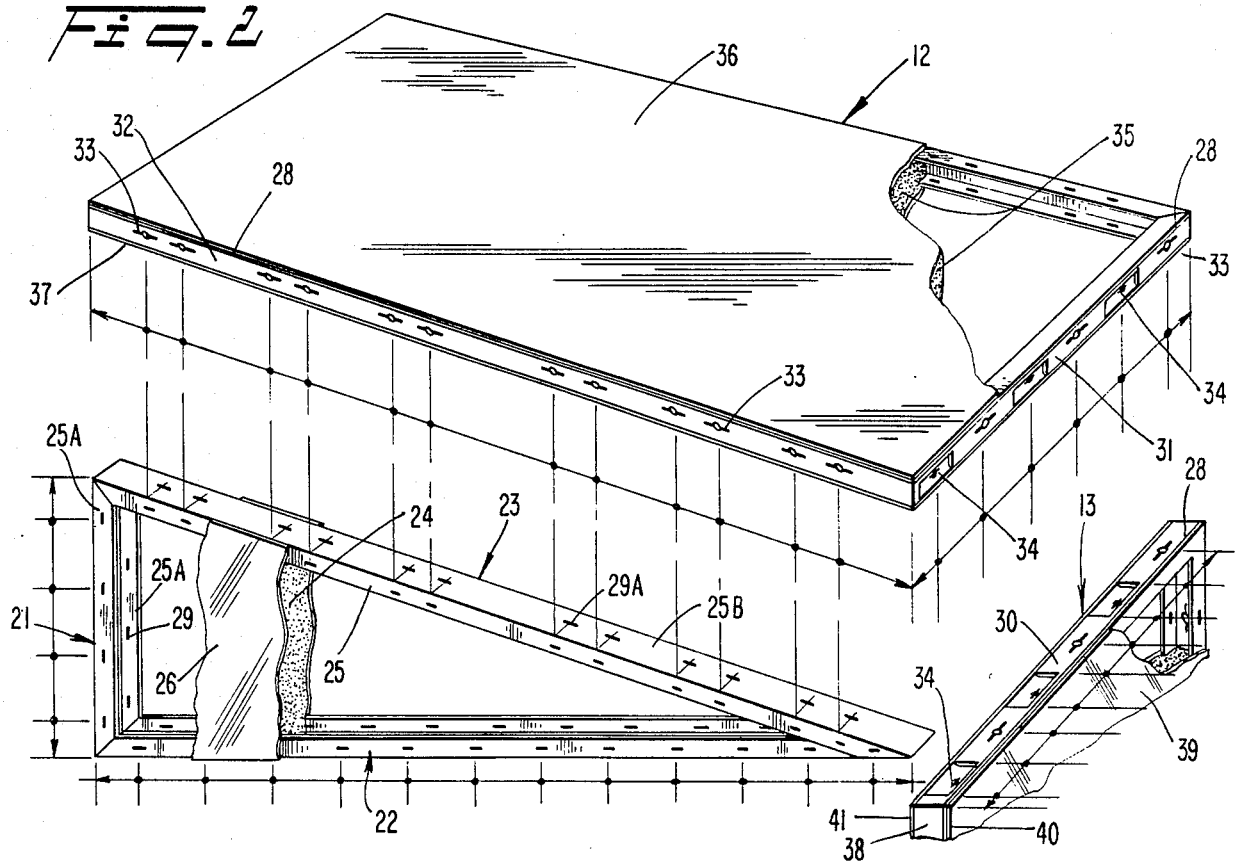
FIG. 2 is an exploded, perspective view of the three basic panel configurations used in the building system of the invention.

The frames around the periphery of the rectangular may have an identical cross-section which includes a diagonal Z-section web 34 as shown in FIG. 2. The only portions where the cut outs are required is at the ridge and eaves of the building where the rectangular panels are joined at the pitch angle of the roof. Thus, in this embodiment the long sides of the panels 12 and 13 are channel shaped as in the gable panel 11.

As shown in FIG. 2, the spacing of the openings 33 in the ends of panels 12 and 13 is identical i.e. 4 inches from each end and laterally spaced 8 inches with respect to each other. Further, the cut out portions reveal webs 34 and are identical on the facing ends as shown. The dimensions of the cut outs which reveal webs 34 and their placement along the edge of are shown on the end of panel 13. The edge of the first cut out is 1 inch from the edge. The width of each cut out is 6 inches. The cut outs are laterally spaced 10 inches apart. There is an 11 inch space from the furthest cut out and the outer edge of panel 13. The other opposite end edge (not shown) of panel 13 is a mirror image of the first end expressly shown in FIG. 2. As shown, the cut outs are in alignment. However, when the panel 13 is rotated 180°, the other end edge structure results in having the flat sections being opposed the cut outs on panel 12. See the details in FIG. 8.

As discussed below, the spacing of the openings along the roof panels 12 are such that wall panels of the overall system may be used in addition to the gable panels 11 and roof panels 12A. This is particularly useful where it is desired to provide structures such as monitors, vents, dormers and the like. Typical buildings of this nature are shown in FIGS. 21–24 herein.

In this specific embodiment the dimensions of gable panel 11 is as follows:

| | Smaller Panel Length | Larger Panel Length |
|---|---|---|
| Short side 21 | 1 ft. - 4 in. | 2 ft. - 8 in. |
| Long side 22 | 4 ft. - 0 in. | 8 ft. - 0 in. |
| Hypotenuse side 23 | 4 ft. - 2⅝in. | 8 ft. - 5¼in. |

A channel shaped extruded aluminum frame 25 extends around the perimeter of all the disclosed panel. Legs 25A of channel shaped frame 25 extend inwardly over the edge of a rigid insulating core 25. Aluminum sheets or skins 26 located on opposite sides of each panel are bonded to insulating core 24 and frame 25 to define a unitary structure. A baked-on enamel or other finish is applied to the outer surface of the sheets 26. A dovetail shaped channel 27 formed in the outer surface of frame 25 receives a neoprene sealing bead 28 therein. The ends of the frame members may be joined to each other in any known conventional manner.

As shown in FIG. 2, a plurality of slotted openings 29 and 29A are laterally spaced along legs 25A and web 25B respectively, of frame 25 at predetermined spacings. The openings 29 in the two sides 21 and 22 are equally and uniformly spaced, while openings 29 and 29A in the hypotenuse are spaced somewhat differently. In a typical structure according to the invention, the endmost slotted openings in each side 21 and 22 are spaced about 4 inches from the end of the respective side and the remaining openings along the side are spaced 8 inches apart. In the hypotenuse however, the endmost openings are spaced inwardly 6⅝ inches from the end and the remaining openings are arranged in pairs of openings spaced $5\frac{3}{8}$ inches apart from another. The centermost spacing is $1'-1\frac{1}{4}''$ thereby matching the two end most spacing of a short roof panel 12A that is one-half the overall length of a long roof panel 12. In this embodiment, the angle formed by the hypotenuse and the long side 22 is equal to 18.5°, thus giving the roof of the building a corresponding pitch. Adding the dimensions given for the spacing of the slotted openings 29 and 29A, gable long side 22 is 8 feet long, gable short side 21 is 2 feet, 8 inches long and the hypotenuse side is about 8 feet, 5$\theta$ inches long.

Roof panels 12 and 12A are rectangularly shaped and include frame end members 31 and side members 32, each with spaced slotted openings 33 therein. The spacing of the openings 33 in side members 32 is identical to that in the hypotenuse side of gable panels 11. The spacing in frame end members 31 is identical to that in the two sides 21 and 22 of gable panels 11. All openings are formed with a slotted hole to receive the blade and the cylindrical shaft of all three fastener types described herein.

Frame end members 30 and 31 include diagonally extending wall or Z-section webs 34 in the web portion of the channel shaped frame members 30 and 31. The web portions of the channel shaped end frame members 30 and 31 are cut out at predetermined spacings to expose the diagonally extending Z-section webs 34. A slotted opening is formed in the diagonally extending Z-section web 34 at the center of the cut out portion. The angular disposition of the diagonal Z-section web 34 is the same as that of the hypotenuse of the gable panel 11. Roof panels 12 and 12A also have a rigid insulating core 35 and protective and/or decorative skins or sheets 36 and 37 laminated on opposite sides thereof. The skins or laminate sheets 36 and 37 extend over the holes in the frame members 31 and 32. Bottom skin 37 is punctured at slotted holes in side members 32 for ease in securing truss members.

A typical, rectangular wall panel 13 shown in FIG. 2 has a channel shaped frame member 30 and 38, rigid insulating core 39 and exterior and interior covering skins 40 and 41 as in roof panels 12 and 12A. However, the spacing of the slotted openings in both the ends and sides of the wall panels 13, 13A, 13B, 13C and 13D is the same as that in the sides 21 and 22 of gable panel 11 and the ends of the roof panels 12 and 12A.

The wall and roof panels 12 and 13 have undercut peripheral channels 27 adjacent the outer skin side of each panel. Neoprene sealing beads 28 located therein effect a seal with adjacent panels abutted in web to web relationship when the building is assembled. Sealing beads 28 are not required at the ridge, eave, gable and corner connections in this embodiment.

FIG. 7 shows roof panels 12 and 12A and wall panels 13 connected to gable panels 11 to form the building structure of FIG. 1, by extending the various fasteners 42, 43 and 44 through the slotted openings in the adjacent edges of the panels. Moreover, at the juncture of the wall and roof panels 12 and 13 at the eaves 16 of building 10, and the ridge 14 of the roof panels 12 at the top of building angled adapter or fastener clips 45 and 46, respectively, connect panels 12 and 13 to one another. Angle clip 45 also joins wall panels at the corners of the building.

FIG. 4 shows fastener 42 having a shaft 47 with flattened blades 48 and 49 at opposite ends thereof. Shaft 47 is formed at its midportion with a hexagonally shaped formation for cooperation with a suitable tool such as a hex head wrench or the like. Such a tool must be thin enough to pass through the narrow opening 50 after two panels abut as shown in FIG. 7. Blades 48 and 49 have tapered and beveled shoulders at their inner edges and are rotated 45° with respect to one another, so that they lie in separate planes. First, blades 48 are pushed through the openings along one panel edge and turned 45°. Then, a second panel is abutted against the first panel. Blades 49 of all the fasteners 42 placed in the first panel then enter into the corresponding slotted openings of the second panel. The fastener 42 is then rotated another 45° with a wrench tool placed from inside the building.

The fastener 43 of FIG. 6 comprises a cylindrical shaft 51 with a pointed blade 52 on one end thereof and a generally triangularly shaped eye 53 on the other end. The blade 52 and eye 53 are rotated 45° relative to one another and have tapered, beveled shoulders 54 at their inner edges. Fastener 44, shown in FIG. 5, is substantially identical to fastener 43, except that it has a hex head 55 at one end of the shaft rather than the eye.

Angle clips 45 are used at the eaves and corners of the building and shaped pieces of metal sized to fit either the cut out areas of the ends of the panels or to nest in the space formed at the juncture of two edge-abutting panels. Clips 45 have predrilled or punched holes therein for receiving the fasteners therethrough. Angle clip 46 used at the ridge of the building, on the other hand, subtends an angle of 55.5° in the example shown. One leg of clip 46 is engaged in flat contact with the diagonal Z-section wall 34 on one roof panel 12A. The other leg of clip 46 is in flat contact with the end web of the channel shaped frame on an adjacent panel 12A. A similar result is obtained at the eaves of the building, as seen in FIG. 7.

Still referring to FIG. 7, the bottom end of a wall panel 13 is secured to a header or continuous wood blocking 56 secured, for example, to a concrete slab, by one or more of clips 45 and a fastener 44. Other clips 45 attach the top end of panel 13 to a roof panel 12A. One leg of each clip 45 projects into the cut out area on the end of the roof panel 12A and is disposed in flat contacting engagement with the diagonal Z-section wall 34. A hex head fastener 44 secures clip 45 to diagonal Z-section wall 34 with the blade of fastener 44 engaged against the rear of the Z-section wall 34. The other leg of clip 45 is fastened to the web of the channel shaped frame member at the end of the wall panel 13. The blade 51 of fastener 43 is engaged behind the web and the eye 52 projecting above the leg of clip 45.

A convex closure strip 16 is secured in covering relationship to the space left between the adjacent ends of the wall and roof panels at the eaves of building 10. Strip 16 comprises a rigid aluminum frame with a central depending wall or flange 57 having spaced slots 58 therein. Neoprene edge seals 59 extend along the opposite side edges of the frame as shown. Retaining arms 60 have hook shaped ends 61 engaged in slots 58 and horizontally projecting, tapered feet 62 engaged in eye 53 of fastener 43. Thus, after the wall and roof panels are assembled together, closure strip 16 with the retaining arm 60 attached thereto is brought into a position with the tapered feet 62 aligned with eyes 53 of fasteners 43 secured in place. Strip 16 is then slid endwise to force the tapered feet 62 into eyes 53, thus snugly pulling down strip 16 and the neoprene edges 59 against the adjacent outer skins of the abutted panels. A substantially similar structure and method are used at the ridge and corners of the building, with strips 14 and 17, and the gable with strip 15. See FIG. 10.

At the side edges of the wall and roof panels, and at junctures between panels which are coplanar with one another, fasteners 42 with blades 48 and 49 on opposite ends are used to secure the panels together. Openings or recessed areas 50 are provided in the frames of the panels to enable access to the hex head formation on shaft 47 of fasteners 42. See FIG. 12.

The pointed blade of fasteners 43 and 44 is used to pierce the aluminum skin covering the slotted openings in the legs of the frame at the edge of the panels. Either eye 53 or hex head 55, depending on which fastener is being used, is then grasped with a suitable tool to turn the fastener to lock the blade behind the frame. In use of fasteners 42 as noted above, the blade at one end is first inserted through the slotted opening in one panel and the fastener rotated through 45° to lock it in place. The other blade is then inserted through a slotted opening in an adjacent panel and the fastener is turned through another 45° to lock the panels together.

The overhead door 18 is secured to the building wall by L-shaped aluminum door frame members 63 attached to the wall panels at opposite sides of the door opening by hex head fasteners 44 and aluminum plates 64 secured thereto. A track 65 is secured to aluminum plate 64 and a wheeled member 66 is carried by the door panels 13D and engaged in track 65. Further L-shaped aluminum frame members 67 are secured to the wall panels 13C and 13D at the edge of the opening to seal against the face of the door 18 when the door is closed. A similar arrangement is used to mount the hinged door 19, except that a hinge 68 is used in place of the wheeled track. See FIG. 9.

Corner and ridge sealing caps 69 are attached to the corners and ends of the ridge of building 10 to seal these areas. Caps 69 comprise an aluminum frame 70 shaped generally as a truncated pyramid and having a neoprene cover secured thereto. In use, a hole is drilled through intersection of the three planes formed by the intersecting frame members at the ridge ends and corners of building 10. A bolt 79 is passed through backplate 71 and a hole of the open frame structure 70 and the drilled hole and secured to nut 77 fixed to frame 70. Back plate 71 is inside the building and triangular shaped to fit the inside corner of the room.

Figure 17:
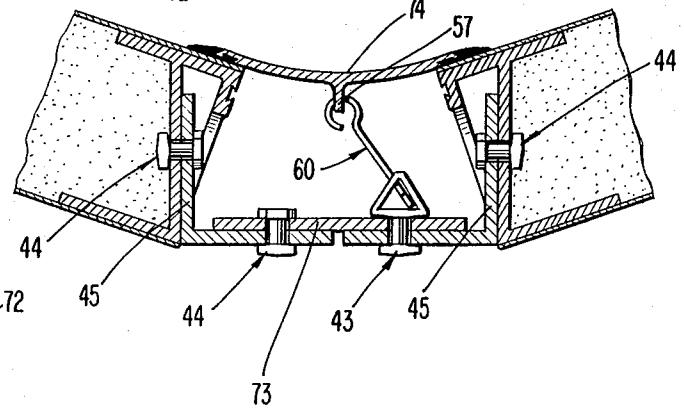
FIG. 17 is a sectional view of an intersecting of two panels in a construction made in accordance with this invention.
Figure 16:
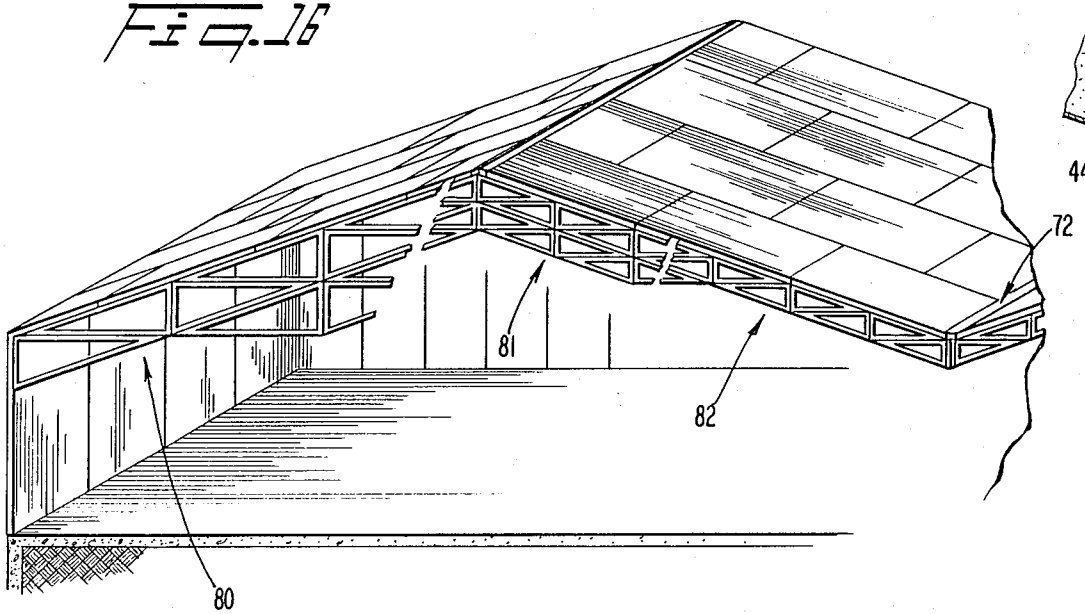
FIG. 16 is a fragmentary perspective view of an open truss variation of a building made in accordance with this invention.

The modified building structure as shown in FIG. 16 is substantially the same as in FIG. 1. However, the basic structure is much wider and does not terminate with a side wall on the near side, i.e. the building continues and the roof extends through a valley 72 and upwardly with the same pitch as in the basic structure. FIG. 17 shows details of the valley construction, wherein two angle clips 45 are disposed so that one of their legs extends horizontally at the bottom of the valley toward the corresponding leg of the opposing clip 45. A flat aluminum plate 73 is mounted on top of the horizontal legs of clips 45 by hex head fasteners 44 at one side and the eye type fasteners 43 at the other side.

A concave closure strip 74 having a central, depending web or flange 57 with spaced slots therein is secured over the valley opening by retaining arms 60 in the same manner as with the closure strips 14, 15, 16, and 17. Neoprene edge seals 59 are attached to the edge of the frame of closure strip 74 along opposite edges thereof to effect a seal with the adjacent roof panels.

Figure 20:
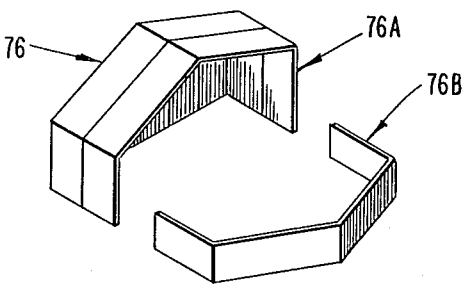
FIGS. 18, 19 and 20 are diagrammatic, perspective views of steps carried out in assembling a building made in accordance with the invention.
Figure 19:
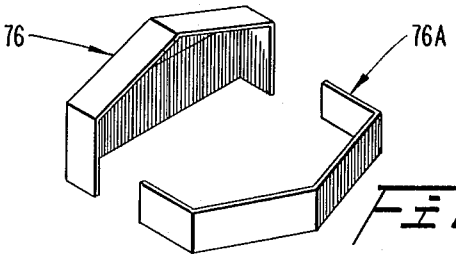
Figure 18:
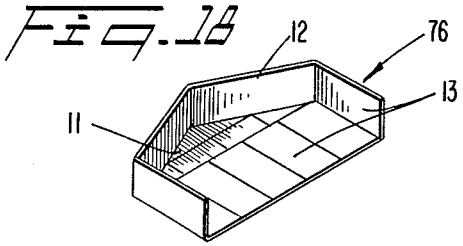

A method of assembling a building structure in accordance with the invention is shown schematically in FIGS. 18, 19 and 20. A plurality of wall panels 13, roof panels 12 and gable panels 11 are assembled and secured together on the ground using the fasteners described herein, to define a bay 76. Bay 76 is then raised into an upright position and secured to the foundation as described earlier. Thereafter, subsequent bays 76A, 76B, etc. are assembled on the ground and raised into an upright position and secured to the preceding bay. As many bays as desired may be secured together to construct a building having any desired size. Erection of a building in accordance with the invention is achieved by assembling one bay at a time, and bays 76, 76A, 76B, etc. are 4 feet wide modules.

Depending upon the size of the building constructed, it may be necessary to provide trusses to support the roof. Several alternate constructions include a full depth truss system 80 shown at the left of FIG. 16; a two tier truss system 81 shown at the center of FIG. 16; and a single tier truss system 82 being shown at the right of FIG. 16. The trusses used are merely the frames of the gable panels 11 with the insulating core and skins eliminated. Eight foot panels 11 may be used for system 80 and four foot panels 11 may be used for systems 81 and 82.

In some cases, it may be necessary or desirable to provide a double line truss rather than a single line (one line of truss members running along the seam between two adjacent panels). In such case, a truss member is secured to each edge of the roof panels. Thus, when the roof panels are joined in edge-to-edge relationship, the truss member at the trailing edge of a preceding panel is joined to the truss member at the leading edge of the following panel to form a double line truss. The rectangular panels have a modular length and width effective to provide a building width that is directly related to the total number of triangular panels used to form a gable end. The building width is equal to a multiple of whole integer times the width of the rectangular panels.

The extruded aluminum frames of the closure strips 14, 15, 16 and 17 flex slightly when pulled taut by the downward pressure applied when retaining arms 60 are secured. Moreover, the retaining arms 60 may be made in an integral unitary construction with the central flange of the strips if desired.

Numerous types of buildings may be constructed using the simplified construction system of this invention. The barn 90 in FIG. 21 has a floor 92 to form a loft space 94. A truss structure having a double tier 91 and single tier 93 and 95 support the floor 92 and lower roof 96 respectively.

Figure 22:
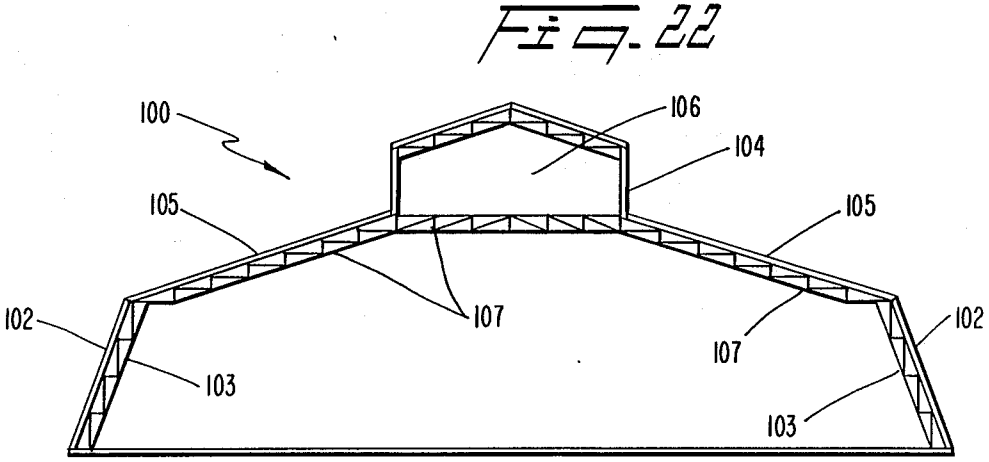
FIGS. 21, 22, 23 and 24 are diagrammatic sectional views of various types of building constructed according to the system of the invention.
Figure 21:
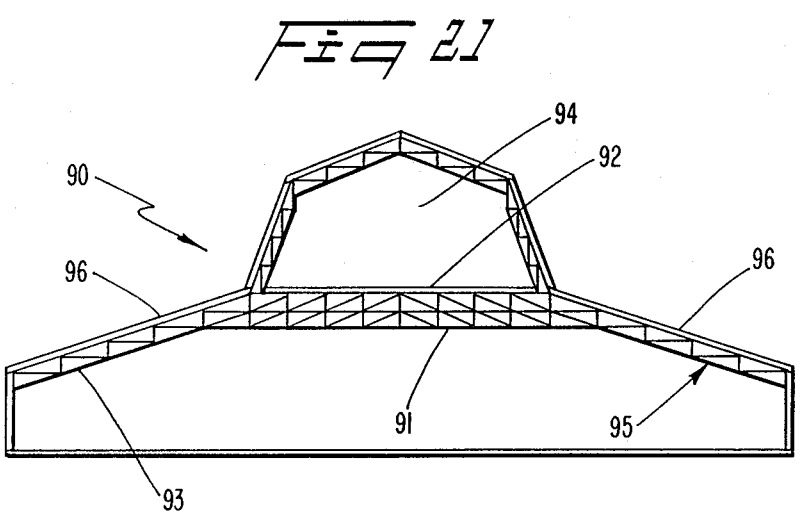
Figure 23:
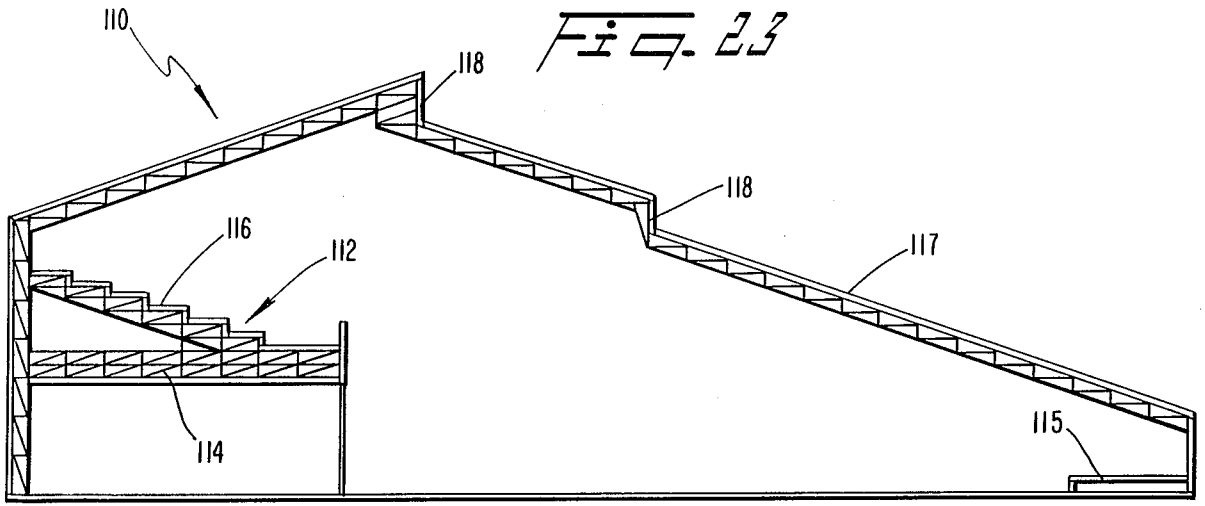
Figure 24:
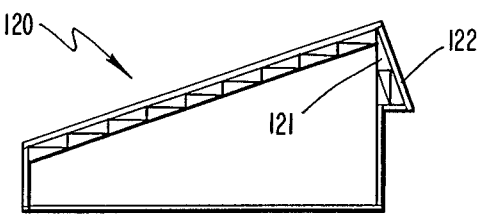

The barn 100 of FIG. 22 includes tapered walls 102 with a corresponding truss section 103. Louvered panels 104 extend upwardly from roof sections 105 to form a clear story 106. The single truss structure 107 supports roof sections 105 and the structure of clear story 106.

The assembly hall 110 includes an inside tiered balcony 112 supported by a truss structure 114 made with the gable panel frame of this invention. Special panels 116 sized to the dimensions of 4 ft.×1 ft. 1 in, may be used to form the steps of the balcony seating and step structures. Monitors 118 extend upwardly from the roof 117 to provide adequate natural lighting to the inside of building 110. A platform or stage 115 is located as the focal point of assembly hall 110. See FIG. 23.

The utility shed 120 presents a most simple building construction formed using the system of this invention.

The overhang section 122 has its size and shape determined by the special disposition of four triangular panels 121 made in accordance with the invention.

ADVANTAGES OF THE INVENTION

The building system created in this invention eliminates or minimizes the two major concerns (1) of many different types, sizes, shapes and materials and (2) the need for heavy, sophisticated equipment for handling building materials. This system incorporates prefabricated panels, fasteners and finishing devices which are proportioned and designed in such a way that a minimum number of the types and sizes of members is utilized in the assembling and erecting of the building. These members are relatively light in weight and can be readily assembled into the desired pattern and size while laying on the ground and then tilted into the upright position, forming the bays of the building. Because the members are light-weight and few in size and shape, they can be easily inventoried, shipped, stored on site and assembled in a minimum period of time and with the employment of little or no equipment (such as cranes, front-end loaders, etc.)

Various sizes and shapes of buildings to meet almost any need dictated by the function of the building can be effected. These structures can be used as agricultural buildings (barns, storage bins, tool sheds, etc.), commercial structures (warehouses, plane hanger, store fronts, offices, etc.), recreational structures (gymnasiums, boat shelters, tennis court enclosures, swimming pool enclosures, etc.), park structures (pavilion for picnics, road side shelters, bus stops, etc.) institutional buildings (classrooms, meeting places, assembly halls, laboratories, etc.) residential structures, industrial structures (factories, garages, etc.) and military structures (barracks, garages, storage shelters, etc.). The panel of the building system can also be used with existing structures to create facades on the exterior walls and partitions oh the interior.

In addition to minimizing the number of part types used in forming the building, this system also minimizes the number and types of tools to be used in erecting the structure and the amount of time needed on a scaffold to perform above ground functions. A major portion of the work, approximately 80%, is done on the ground with the panels forming the walls and the roof, and where necessary, the truss members and window units. Thus, the entire system gives optimum results in that everything is completed in one operation, i.e. the frame, insulation and finish are all incorporated in one operation.

While the building structure and method have been described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A prefabricated, modular building construction system comprising:

(a) a plurality of prefinished panels including rectangular roof panels and wall panels and right-triangular gable panels having first, second and hypotenuse sides, said panels to be secured together at adjacent edges to define walls and a roof, (b) each of the panels having a unitary structure defined by a rigid frame extending around the edges thereof, and a rigid insulating core and protective skin disposed at each side of the core and frame, (c) the hypotenuse side being disposed at a predetermined angle with respect to the other two sides of the gable panels to determine the roof pitch of the building to be constructed, (d) the length of the roof panels being equal to a whole integer multiple of the length of the hypotenuse side, (e) the panel frames comprises channel shaped member having legs extending over the marginal edges of the insulating core and webs defining the outer peripheral edge of the panels, (f) a plurality of spaced, slotted openings in the frames of said panels, (g) the slotted openings being formed in both the legs and web of the frames, (h) the spaced distances between openings (1) in the two perpendicular sides of the gable panels, (2) in the ends and sides of the wall panels and (3) in the ends of the roof panels are equal to one another, (i) the openings along the sides of the roof panels being spaced at a distance equal to a spaced distance between the openings along the hypotenuse of the gable panels, (j) the length and width of the wall panels and the width of the roof panels are whole integer multiples of the length dimensions of the first and second sides of the gable panels, and (k) fasteners including an enlarged blade at least at one end thereof and having a structural configuration effective for insertion through aligned slotted openings in adjacent panel edges, (l) said fasteners being turnable to lock said at least one blade behind the frame to secure the panels together, (m) the frame members at the ends of the walls and roof panels have diagonal members extending between the legs thereof, (n) the webs include cut-out areas at the ends of the wall and roof panels to provide access to the diagonal members which have a slotted opening in the center of the cut-out areas for receiving a fastener, (o) the secured prefinished panel defining a completed building structure.

2. A prefabricated, modular building construction system comprising:

(a) a plurality of prefinished panels to be secured together at adjacent edges to define walls and a roof, (b) each of the panels having a unitary structure defined by a rigid frame extending around the edges thereof, and a rigid insulating core and protective skin disposed at each side of the core and frame, (c) a plurality of spaced, slotted openings in the frames of said panels and, (d) fasteners including an enlarged blade at least at one end thereof and having a structural configuration effective for insertion through aligned slotted openings in adjacent panel edges, (e) said fasteners being turnable to lock said at least one blade behind the frame to secure the panels together, (f) the secured prefinished panels defining a complete building structure, (g) closure strips are secured over the juncture between adjacent panels which are joined at the angle, closing the space left by such angular disposition of the panels, and (h) the fasteners include adapter clip angles having opposite legs engaged against the frame members of adjacent panel edges, (i) the clip angles having centered slotted openings therein in registry with the spaced openings in the frame members, (j) headed fasteners are inserted through the openings in the clip angles and the frame members to secure the panels together via the clip angles and headed fasteners.

3. A building construction as defined in claim 2 wherein the fasteners include fastening members having an enlarged eye on one of the ends, and a closure retaining arm is engaged between the closure strip and the eye of the fastening member, the retaining arm having a tapered foot engaged in the eye to urge the closure strip downwardly against the adjacent panels.

4. A building construction as defined in claim 3 wherein the fasteners include securing members having a shaft extending between two enlarged blades, with a hexagonally shaped formation in the middle of the shaft for engagement with a tool to rotate the securing member after the enlarged blades are inserted through the slotted openings in adjacent panels, and the enlarged blade on one end of some of the fasteners is pointed for piercing the skin of the panels.

5. A building construction as defined in claim 2 wherein one of the legs of the adapter clip angles is positioned through the cut-out area in the panel end frame member of one of two adjacent panels and is engaged with the diagonal member behind the cut-out area.

6. A prefabricated, modular building construction system comprising:

(a) a plurality of prefinished panels including rectangular roof panels and wall panels and right-triangular gable panels, said panels to be secured together at adjacent edges to define walls and a roof, (b) each said panel having a side mathmatically related to a side of each of the other two panels with the shape and size of the gable panel forming the basic module for the system, (c) the gable panel being a single-shaped, right-triangular building panel having a short side, a long side and a hypotenuse side with the hypotenuse side disposed at a predetermined angle with respect to the short and long sides thereof to define the pitch of the roof of a building being constructed, (d) the wall panel being rectangular with one of its sides being equal in length to a whole integer multiple of one of the long or short sides of the triangular gable panel, (e) the roof panel being rectangular with one of its sides being equal in length to one of the sides of the rectangular wall panel and the other one of its sides being equal in length to a whole integer multiple of the length of the hypotenuse side of the triangular gable panel, and (f) each of the panels having a unitary structure defined by a rigid frame extending around the edges thereof, and a rigid insulating core and protective skin disposed at each side of the core and frame, (g) a plurality of spaced, slotted openings in the frames of said panels, and (h) fasteners including an enlarged blade at least at one end thereof and having a structural configuration effective for insertion through aligned slotted openings in adjacent panel edges, (i) said fasteners being turnable to lock said at least one blade behind the frame to secure the panels together, (j) the secured prefinished panels defining a complete building structure.

7. The system as defined in claim 6 wherein the openings along the sides of the roof panels are spaced at a distance equal to a spaced distance between the openings along the hypotenuse side of the gable panels.

8. The system as defined in claim 6 wherein the spaced distances between openings (1) in the two perpendicular sides of the gable panels, (2) in the ends and sides of the wall panels and (3) in the ends of the roof panels are equal to one another, and the length and width of the wall panels and the width of the roof panels are whole integer multiples of the length dimensions of the short and long sides of the gable panels.

9. The system as defined in claim 6, wherein the ends of the roof panels and wall panels which may be adjacent to the ridge or eaves of the building include a Z-section portion which defines a web disposed at an angle with respect to the outer web of the panels peripheral frame that is equal to said predetermined angle.

* * * * *